United States Patent [19]

Miller

[11] 3,996,490

[45] Dec. 7, 1976

[54] BUTTABLE FLAT PANEL DISPLAY MODULE

[75] Inventor: Donald E. Miller, Asbury, N.J.

[73] Assignee: Burroughs Corporation, Detroit, Mich.

[22] Filed: June 6, 1975

[21] Appl. No.: 584,549

[52] U.S. Cl. ..... 313/217; 313/220

[51] Int. Cl.[2] ..... H01J 61/06

[58] Field of Search ..... 313/217, 220, 188, 519

[56] References Cited

UNITED STATES PATENTS

| | | | |
|---|---|---|---|
| 3,711,733 | 1/1973 | Skutt | 313/220 X |
| 3,886,390 | 5/1975 | Maloney et al. | 313/217 |
| 3,917,972 | 11/1975 | Yanagisawa et al. | 313/217 X |

*Primary Examiner*—Robert Segal
*Assistant Examiner*—Darwin R. Hostetter
*Attorney, Agent, or Firm*—Kevin R. Peterson; Robert A. Green; William B. Penn

[57] ABSTRACT

The panel includes a base plate, a face plate, and a slotted insulating plate therebetween, all three parts being sealed together to form a gas-tight, gas-filled envelope. Strip-like cathode electrodes are provided on the base plate, and an array of alternating display and scan anodes are provided on the face plate overlaying the cathodes to define, with the slotted plate, alternating scan and display cathodes. The arrangement provides rows and columns of scan cells and display cells. The scan cathodes and scan cells are not viewed and serve to supply excited particles to the display cells, and the rows and columns of display cells comprise a dot matrix which is used to display messages. The cathode and anode connections are specially formed so that all appear at the lower edge of the panel, at which external circuitry can be connected thereto to permit individual panels to be butted together to form a large wallboard display.

2 Claims, 9 Drawing Figures

Fig. 8
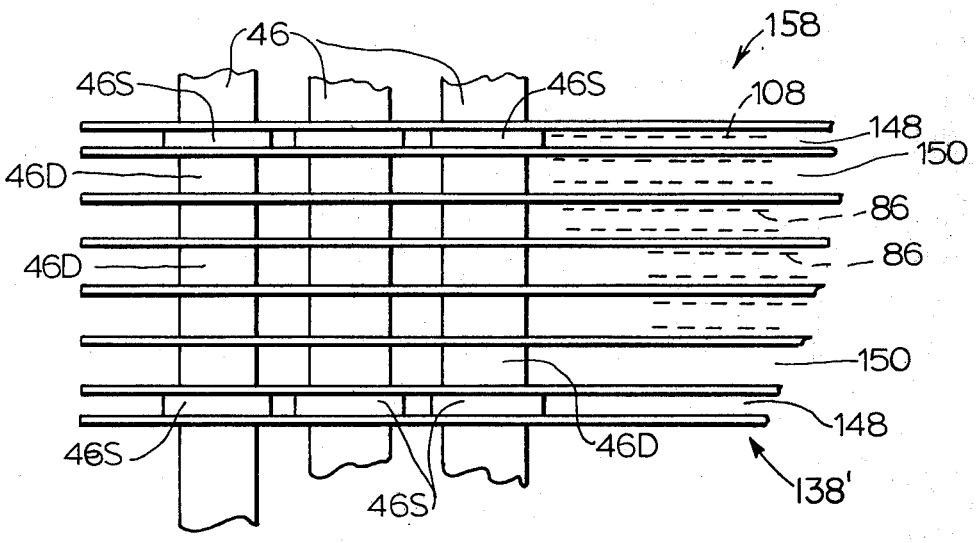
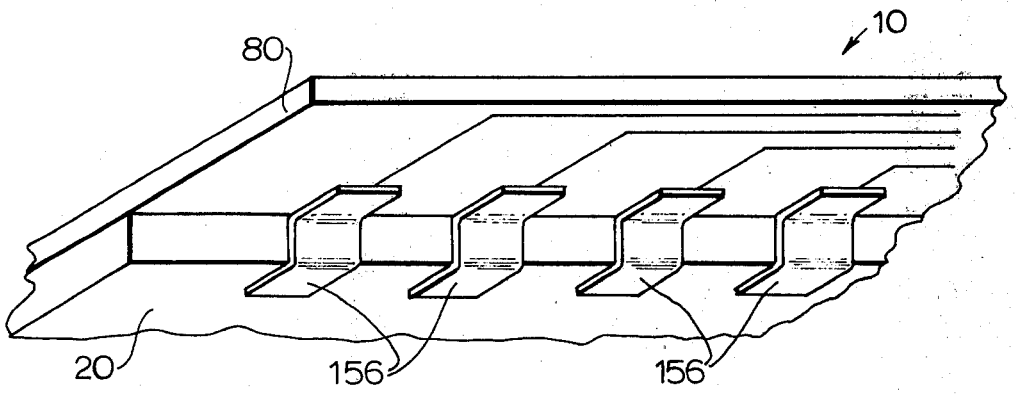
Fig. 9

BUTTABLE FLAT PANEL DISPLAY MODULE

BACKGROUND OF THE INVENTION

Flat display panels for displaying characters or messages have been known for some time, both in single register and multi-register form. In addition, there has been an ever-present need for large display panels of wall size; however, panels of this size have not been obtainable commercially. An alternative to making a single panel of large size is to make smaller panel modules and to couple together such panel modules to form a total large-area panel. However, suitable panel modules have not been available for this purpose.

SUMMARY OF THE INVENTION

The present invention provides a display panel module which itself is of relatively large size and has its electrodes and terminals arranged so that panels can be readily butted together to form composite large-area panels.

DESCRIPTION OF THE DRAWINGS

FIG. 8 is a plan view of another portion of a modification of the invention; and FIG. 9 is a perspective view of a portion of the lower surface of the panel of the invention.

DESCRIPTION OF THE PREFERRED EMBODIMENTS

Figure 1:
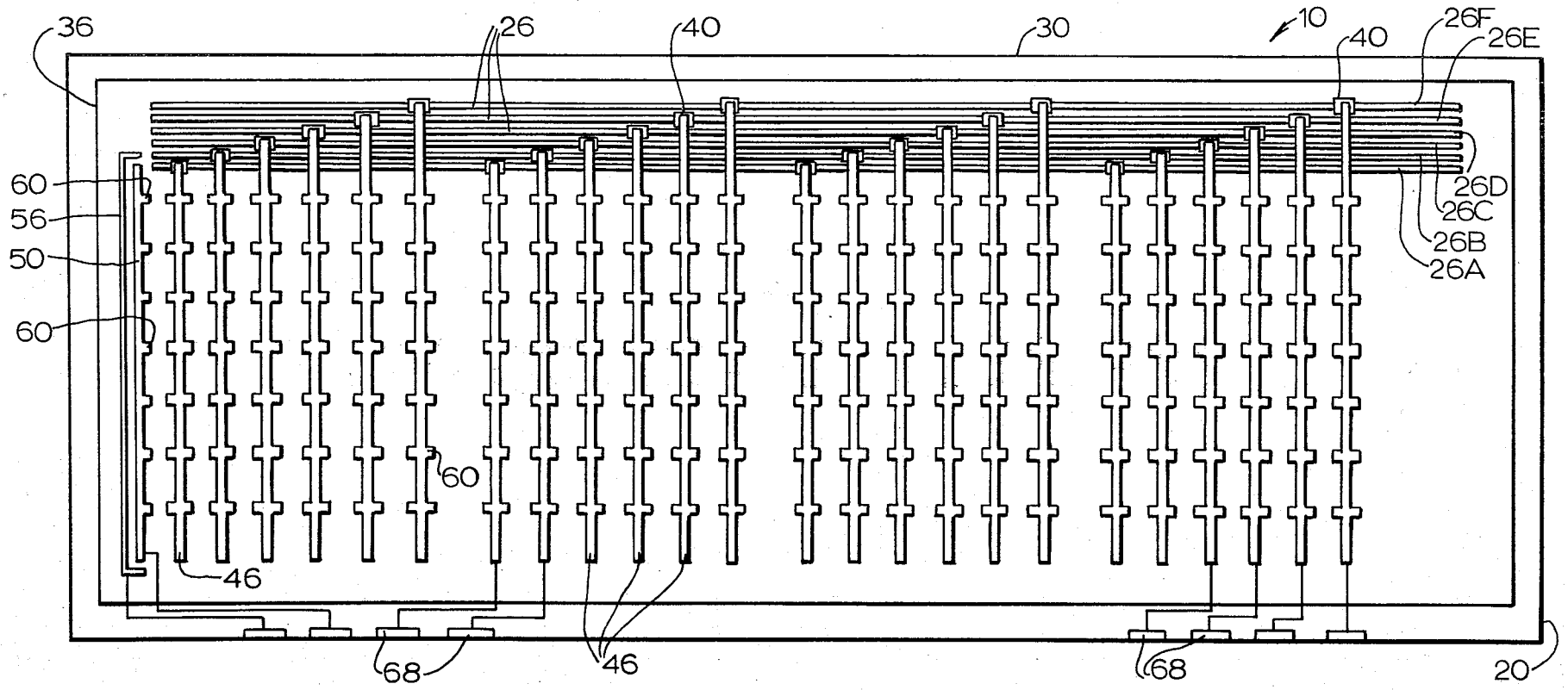
FIG. 1 is a plan view of the base plate of a display panel embodying the invention.

According to the invention and referring to FIG. 1, a display panel 10 includes a base plate 20 having a top surface 24 on which are formed six horizontal conductive runs 26 (A to F) disposed parallel to each other and to the long axis of the base plate adjacent to the upper edge 30 thereof. Six runs are provided to illustrate that the cathodes (to be described) can be operated in six phases; however, other numbers of phases and a corresponding number of conductive runs could be used. An insulating layer 36 of a glass-like material is formed over the top surface of the base plate and covering the conductive runs except for groups of apertures 40 formed over the conductive runs 26. As shown, in each group of apertures, one aperture is provided for each of the conductive runs, and there are six apertures in each group.

A plurality of conductive strip electrodes 46, to be used as cathodes, are provided on the insulating layer 36, the electrodes 46 being parallel to each other and oriented transverse to the conductive runs 26, with each electrode 46 having its upper end in contact with one of the conductive runs through an aperture 40 in layer 36. Thus, the electrodes 46 are connected in groups, with six electrodes in each group, with each electrode in the group in contact with a different run 26, and with the first cathode of each group connected to run 26A and comprising phase 1, the second of each group connected to run 26B and comprising phase 2, etc.

As an example of a different arrangement, if the electrodes 46 were to be connected for three-phase drive, then three runs 26 would be provided or would be used, there would be three electrodes 46 in a group, and each electrode in a group would contact a different one of the three runs.

The first cathode electrode 46A of the first group at the lefthand end of the base plate, as seen in FIG. 1, is considered to be the first electrode of the series, and to the left thereof is provided a first auxiliary strip electrode 50 parallel thereto, and a second auxiliary strip electrode 56 parallel to the others. In the completed panel, the strip electrodes 46 are operated as scan and display glow cathodes; the first auxiliary strip electrode 50 is operated as the reset cathode, and the second auxiliary strip electrode 56 is operated as a keep-alive cathode.

To facilitate the operation of these strip electrodes for their intended purposes, the keep-alive cathode 56 is positioned close to and in intimate operative relation with reset cathode 50. In addition, reset cathode 50 and the strip cathodes 46 are provided with aligned lateral tabs 60, which are disposed in rows so that cathode glow can readily transfer from one electrode to the adjacent electrode in the series. The tabs 60 are preferably aligned with the portions of the cathode strips 46 which are operated as scanning or priming cathodes, to be described below.

The keep-alive cathode 56, the reset cathode 50, and one cathode 46 of each phase is connected to a conductive contact pad 68 at the lower edge of the base plate 20 by suitable conductive runs. The pads 68 are positioned so that they are arrayed in two groups of four, with one group being disposed near the lefthand end of the base plate, and the other group being disposed near the righthand end of the base plate. This arrangement is designed to accommodate other pads and connections on the face plate of panel 10 to be described below.

Figure 2:
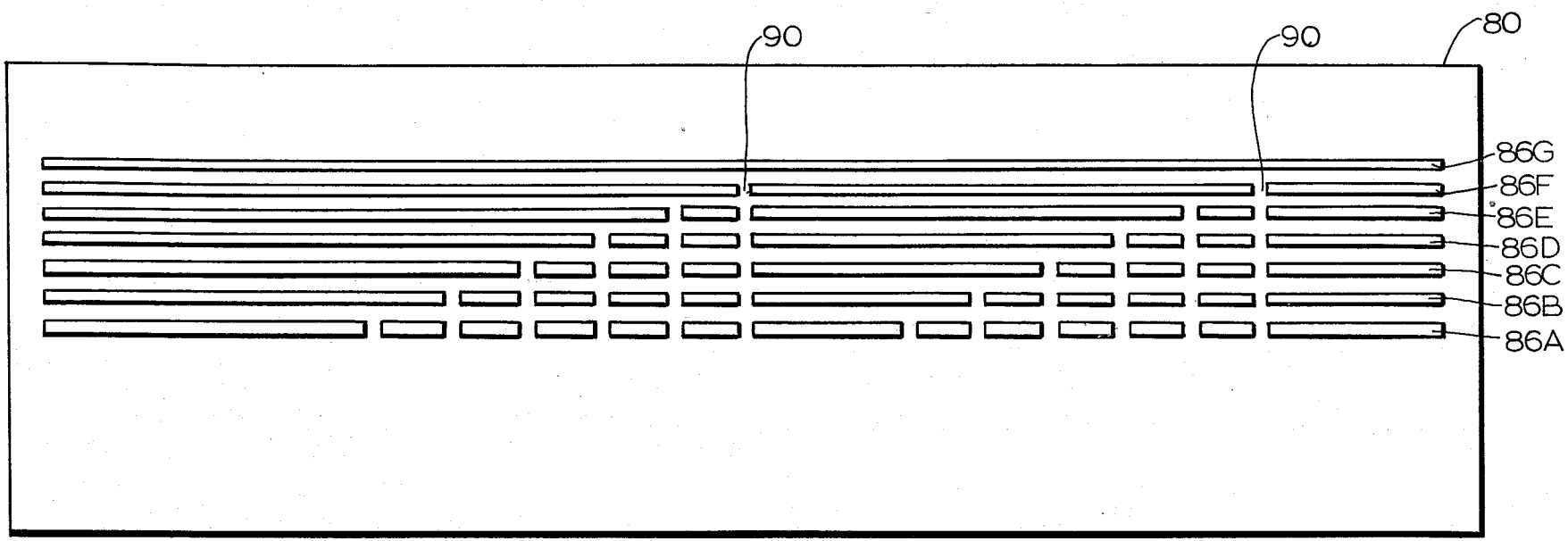
FIG. 2 is a plan view of the bottom surface of the face plate used with the base plate of FIG. 1 at one stage in its preparation.

The face plate 80 of the panel 10 is preferably of glass and is provided with electrodes and other elements as follows. Looking at the bottom surface of the face plate in FIG. 2, first, parallel transparent conductive strips 86 (A-G) of tin oxide or the like are formed, preferably seven in number, and numbered one through seven beginning with the lower-most strip 86A. The upper-most strip 86G, number seven, is continuous; strip 86F, number six has two spaced-apart discontinuities 90; strip 86E, number five, has four spaced-apart discontinuities, etc.; and all of the discontinuities are aligned in columns, there being two sets of columns, each having six columns, one set being for the scan anode connections, and one set being for the display anode connections to be described. In each set of columns of discontinuities, the first or leftmost has one discontinuity, the second has two discontinuities and extends through two conductive strips, the third column of discontinuities extends through the three lower conductive strips, the fourth column of discontinuities extends through the four lower conductive strips, etc., and the sixth column includes six discontinuities and extends through all but the top strip 86G.

Figure 3:
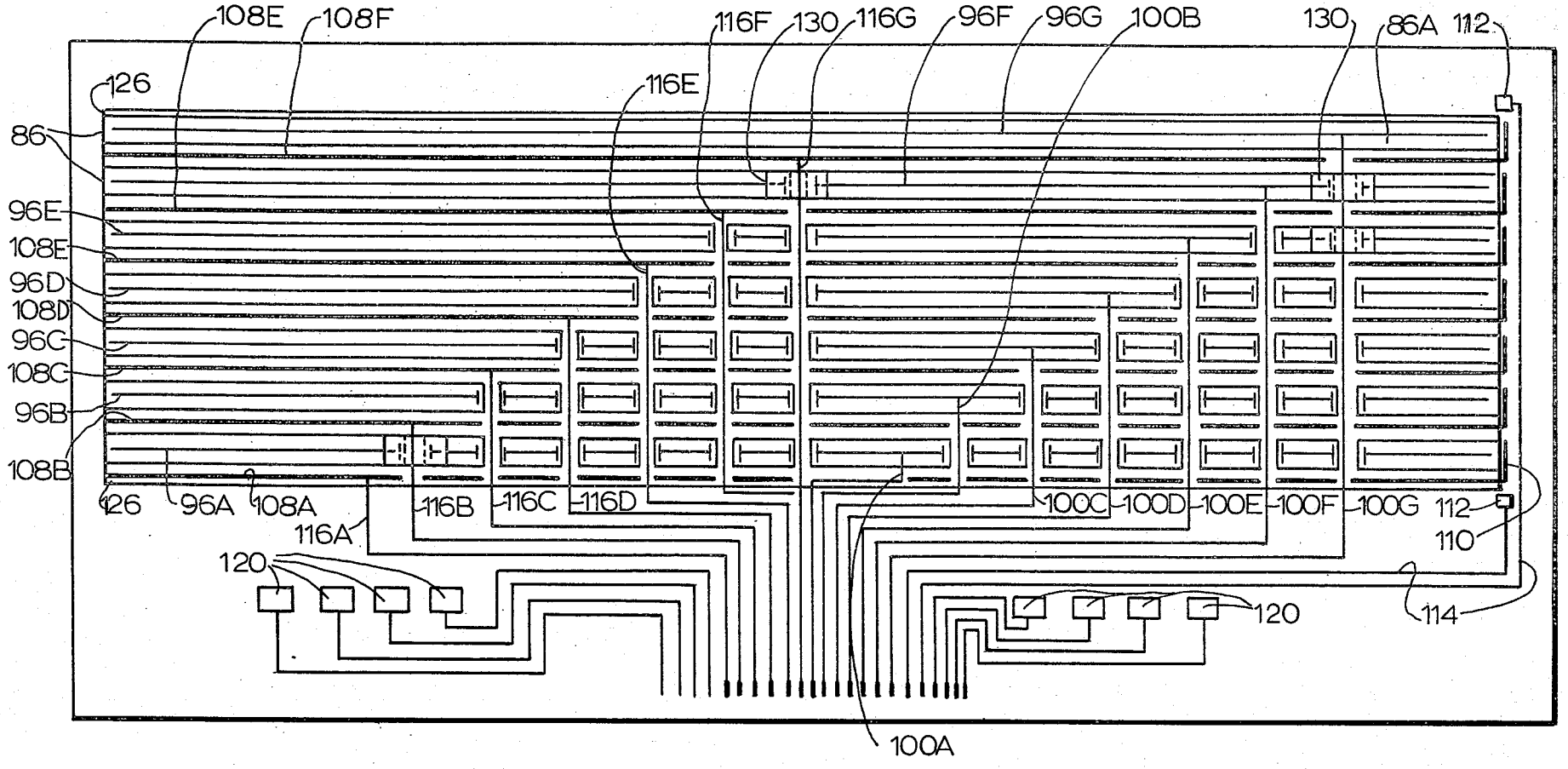
FIG. 3 is a plan view of the bottom surface of the face plate of FIG. 2 at a later stage in its preparation.

Those skilled in the art will appreciate, when the invention is described completely, that any suitable arrangement of the discontinuities can be used. For convenience, the sixth column, the longest column of the left-most set, is located at about the center of the face plate. Referring to FIG. 3, after the conductive strips 86 have been formed, these strips comprising the display anodes of the completed panel, very narrow conductive lines 96 (A to G) of silver or the like are formed on the conductive strips 86, with such conductive lines having discontinuities at the discontinuities in the conductive strips. The top-most or seventh conductive line 96G, has a transverse portion or lead 100G which extends along the sixth column of the righthand group of discontinuities, the sixth conductive line 96F has a transverse portion 100F which extends along the fifth column of discontinuities, etc. The transverse portions are used to connect the electrodes of the panel to external circuitry.

In addition, conductive lines 108 (A to G), which are wider than conductive lines 96 and comprise the scan anodes in the completed panel, are formed on the lower surface of the face plate. These lines are of silver or the like and are opaque and are disposed between the transparent conductive anode strips 86. The scan anode lines 108 are also seven in number, with the lower-most or first 108A being disposed beneath and adjacent to the lower-most or first transparent conductive strip 86A. The wider conductive lines 108 have discontinuities at the same locations as all of the other discontinuities. The righthand end of each line 108 has a short transverse portion 110, and all of these transverse portions 110 are vertically aligned closely adjacent to the righthand ends of the strips 86. Electrode portions 110 are used as reset anodes in conjunction with reset cathode 50 on the base plate.

Each conductive line 108 has a transverse portion or lead 116 (A to G) which extends along a column of discontinuities as described above for the narrow lines 96, and these portions are used to make connections to external circuitry.

A pair of small-area, generally rectangular keep-alive anodes 112 are provided adjacent to the series of reset anodes 110, preferably one at each end of the series and having leads 114 for making connection to external circuitry.

All of the lead portions 100, 114, and 116 are brought out to the central portion of the lower edge of the bottom surface of the face plate, as seen in FIG. 3, so that external electrical connections can be made thereto. In addition, two groups of conductive pads 120, four in each group, are provided at the left and righthand regions of the lower edge of the face plate for connection to the two groups of pads 68 on the base plate when the panel is assembled.

Figure 4:
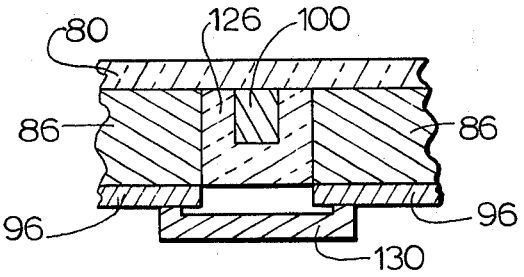
FIG. 4 is an enlarged sectional view of a portion of the face plate shown in FIG. 3.
Figure 6:
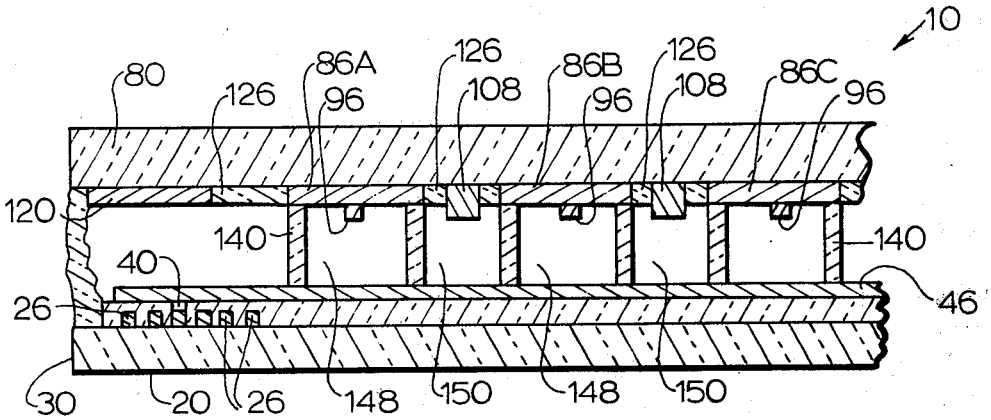
FIG. 6 is a transverse sectional view of the panel of the invention, assembled.
Figure 5:
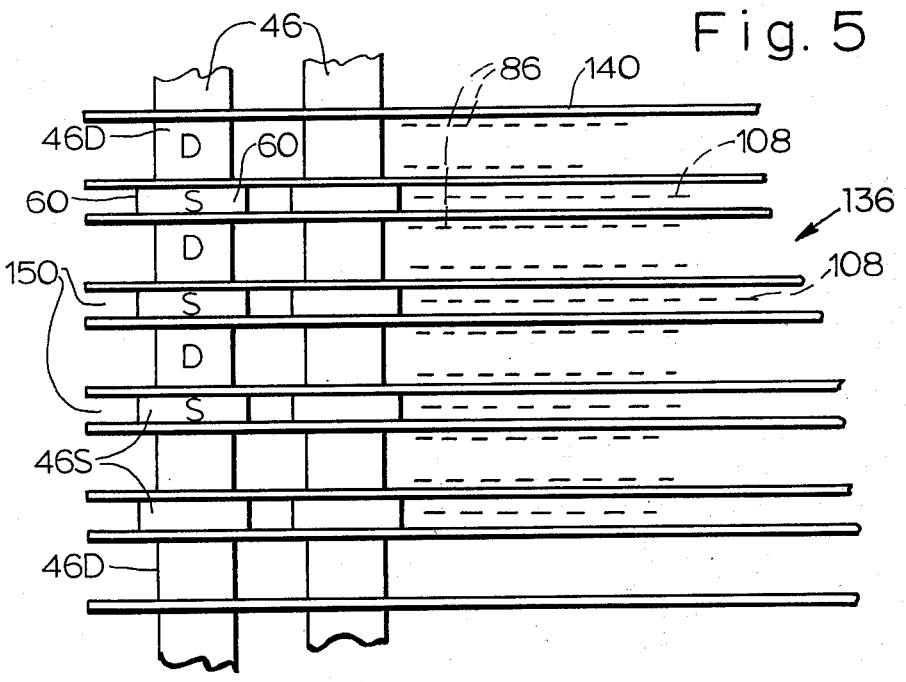
FIG. 5 is a plan view of a portion of the panel of the invention.

A layer 126 of insulating opaque material is formed on the lower surface of the face plate covering all open areas of the face plate, all of the transverse portions 100 and 108 of the display anode lines and scan anode lines, respectively, and any other elements which should not be visible through the face plate. Finally, bridging portions 130 of conductive material, only some of which are shown in FIG. 3 and one of which is shown in enlarged FIG. 4, are disposed on the insulating layer 126 and electrically connecting all spaced-apart portions of the display anode lines 96 and scan anode lines 108 to form electrically continuous lines of each. The bridging portions 130 may be of silver or the like.

The panel 10 also includes an insulating spacer 136 disposed between the base plate 20 and face plate 80, in the completed panel, seated on the cathode strips 46, and supporting the face plate. The spacer 136 has a pattern of ribs which, for all practical purposes, matches the pattern of insulating layer 126. The spacer, thus, includes longitudinal ribs 140 which are spaced apart to define alternate wide and narrow horizontal channels 148 and 150, respectively. The wide channels are aligned with the display anodes 86, and the narrow channels are aligned with the scan anodes 108. Since the ribs 140 rest on the cathode strips (FIG. 4), they, in effect, divide the cathode strips into generally rectangular areas. The wide channels 148 between the ribs define portions 46D of the cathode strips 46 which are visible through the transparent display anodes 86 and are operated as display cathodes. The narrow channels 150 between the ribs define portions 46S of the cathode strips including the lateral tabs 60 which are scan cathodes and are hidden from view by the metallic scan anode lines 108 and by the insulating material 126.

The cathode portions 46D and 46S and their associated anodes define display cells and scan cells. The scan cells may also be called particle supply cells or priming cells since they are used to generate excited particles for use in assisting the associated display cells to glow when they receive energizing signals.

The spacer 136 also includes transverse ribs 154 which provide strength for the spacer and are aligned with the columns of discontinuities and with the transverse conductors 100 and 116.

The base plate 20 and face plate 80 are assembled with the spacer 136 between them, and the parts are hermetically sealed together to form a gas-tight envelope by means of a glass frit or the like disposed along aligned portions of the parts. The envelope is filled with the desired gas by means of a tubulation or in any other suitable manner.

As shown, the face plate is wider than the base plate so that the lower portion thereof which carries the electrode portions, to which external contact is to be made, extends beyond the lower edge of the base plate. The pairs of aligned pads 68 and 120 are electrically connected by layers 156 of a conductive paint or the like.

Figure 7:
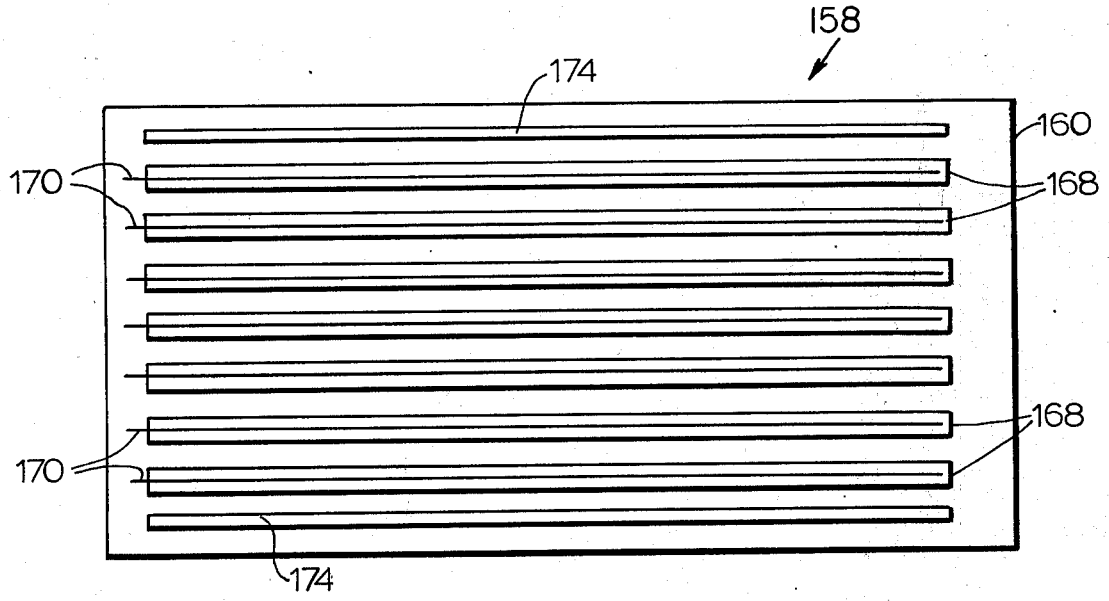
FIG. 7 is a plan view of a portion of a modification of the invention.

In panel 10, each scan cell is in operative relation with one display cell. A panel 158 illustrated in FIGS. 7 and 8 embodies a modification of the invention and utilizes a principle of operation known as shared scan, in which each scan cathode or scan cell is in operative relation with more than one display cathode or display cell. This modification can use base plate 20 and the electrodes carried thereby as described above; however, the face plate 160 is provided with seven display anode strips 168 (and their associated narrow conductive lines 170) disposed adjacent to each other but without scan anode strips between them as in FIG. 3. In this case, two opaque scan anode strips 174 are provided, one along the upper margin, and one along the lower margin of the array of display anodes 168 and positioned closely adjacent to display anode strips 86A and 86G. In this panel 158, an insulating spacer 138′ is used in which the ribs 140 are arranged so that two narrow channels 148, which define and are aligned with rows of scanning cathodes or cells 46S, are provided only at the upper and lower margins thereof, and seven wider channels 150, aligned with the display anodes 168 and with the rows of display cathodes, are provided therebetween. Rows of display cells 46D and upper and lower rows of scan cells 46S are thus formed by the ribs 140 of spacer 138'.

One advantage of the panels described herein is that they may be butted end-to-end to form composite panels which can display a row of characters of considerable length. End-to-end butting is particularly suitable since all circuit-connecting pads are disposed along the lower edge of the panel. In addition, the electrode structures are such that the last column of display cells of one panel and the first column of an adjacent panel can have minimal spacing between them. Several rows of such panels can be assembled to provide a composite multi-register panel.

The panels described herein may be operated in the same manner generally as panels described in copending application Ser. No. 551,359, filed Feb. 20, 1975. Briefly, in operation of such panels, the keep-alive anodes and cathode are energized to maintain a constant source of excited particles, and, with operating potential applied to all of the scan anodes 108, simultaneously, first reset cathode 50 is energized and then each of the cathode strips 46 is energized, in turn, beginning with the first and continuing to the last. This operation causes each column of scan cells represented by scan cathodes 46S to glow and to generate excited particles, in turn. As each such column of scan cells is energized and caused to glow, information signals are applied to selected display anodes 96 and 86, and the display cathodes 46D and the display cells defined thereby which are associated with such energized display anodes, are caused to glow with the aid of excited particles generated by the associated scan cells. The display cells in each column which glow, as the columns of scan cells are energized, combine to represent a character or message, and, as the panel is continually cycled, a stationary but changeable message is displayed.

What is claimed is:

1. A display panel comprising a gas-filled envelope including a base plate and a face plate hermetically sealed together with a gas-filled space between them, said envelope having a long axis and a short axis, a plurality of parallel strip-like cathode electrodes on said base plate and oriented parallel to said short axis of said envelope, said cathode electrodes being connected to first contact pads at an edge of said base plate, a plurality of display anode electrodes and scan anode electrodes disposed on the lower surface of said face plate and oriented transverse to said cathode electrodes and parallel to said long axis of said envelope, a transverse lead extending from each display anode and each scan anode to a second contact pad at the edge of said face plate which overlays said edge of said base plate, said transverse leads being disposed on the bottom surface of said face plate and a plurality of said transverse leads passing through breaks in said display anodes and scan anodes, there being connecting bridges across said breaks and insulated from said transverse leads.

2. A display panel comprising a gas-filled envelope including a base plate and a face plate hermetically sealed together with a gas-filled space between them, a plurality of paralled strip-like cathode electrodes on the top surface of said base plate, said cathode electrodes being connected to first contact pads at an edge of said base plate, a plurality of parallel elongated anode electrodes formed on the lower surface of said face plate, all but one of said anode electrodes having a gap in its length and thus comprising two portions having adjacent ends spaced apart from each other, a transverse connecting lead extending from each anode electrode to a second contact pad at an edge of said face plate overlaying said edge of said base plate, each said transverse connecting lead located on the bottom surface of said face plate and positioned in the gaps in said anodes which it passes on its way to its second contact pad, insulating material covering said transverse leads in said gaps, and bridging conductors on said insulating material and electrically connecting the adjacent ends of all of said anode electrodes having said gaps.

* * * * *